US006408997B1

(12) United States Patent
Chen

(10) Patent No.: US 6,408,997 B1
(45) Date of Patent: Jun. 25, 2002

(54) STRUCTURE FOR EXPANDING HOLDING CAPACITY OF LUGGAGE

(76) Inventor: Shou-Mao Chen, 344, Sec.1, Chung Shan Rd., Ta-Cha Township, Taichung Hsien (TW)

( * ) Notice: Subject to any disclaimer, the term of this patent is extended or adjusted under 35 U.S.C. 154(b) by 0 days.

(21) Appl. No.: 09/789,088

(22) Filed: Feb. 21, 2001

(51) Int. Cl.[7] ..... A65C 7/00
(52) U.S. Cl. ..... 190/103; 190/107
(58) Field of Search ..... 190/103, 104, 190/105, 107, 14, 15 R, 21, 22, 24

(56) References Cited

U.S. PATENT DOCUMENTS 3,447,648 A * 6/1969 Schwennicke ..... 190/103
5,671,831 A * 9/1997 Chiu ..... 190/103
6,220,411 B1 * 4/2001 Scicluna et al. ..... 190/103
6,305,513 B1 * 10/2001 Lu ..... 190/103

* cited by examiner

*Primary Examiner*—Lee Young
*Assistant Examiner*—Lien Ngo
(74) *Attorney, Agent, or Firm*—Harrison & Egbert

(57) ABSTRACT

A luggage is formed of a main body, a cover body, and an expansion portion connecting the main body and the cover body. The main body has a frame which is provided in opposite inner sides with an expansion structure including two slide rails, an expansion board, and two retaining rods. The expansion board is fastened to a frame of the cover body such that the expansion board can be moved along the two slide rails. The holding capacity of the luggage can be thus adjusted.

2 Claims, 8 Drawing Sheets

STRUCTURE FOR EXPANDING HOLDING CAPACITY OF LUGGAGE

BACKGROUND

1. Field of the Invention

The present invention relates generally to a luggage, and more particularly to structure for expanding the holding capacity of the luggage.

2. Description of Related Art

As shown in FIG. 1, a prior art luggage 10 comprises a main body 11, a cover 12, and an expansion portion 13. The expansion portion 13 is located between the main body 11 and the cover 12 in conjunction with a zipper 14. The holding capacity of the prior art luggage 10 is expanded by unfastening the zipper 14. The expansion portion 13 is made of a fabric material. The prior art luggage 10 is defective in design because the expansion portion 13 is vulnerable to being torn, and because the expansion of holding capacity of the luggage 10 is limited, and also because the expanded luggage 10 is apt to disfigure.

BRIEF SUMMARY OF THE INVENTION

The primary objective of the present invention is to provide a luggage with a structure for expanding effectively the holding capacity of the luggage.

The luggage of the present invention comprises a main body and a cover body. The main body has a frame which is provided in opposite inner sides thereof with an expansion structure. The expansion structure is formed of two slide rails an expansion board, and two retaining rods. The expansion board is fastened to the cover body frame. The holding capacity of the luggage of the present invention can be adjusted at will.

DETAILED DESCRIPTION OF THE INVENTION

Figure 1:
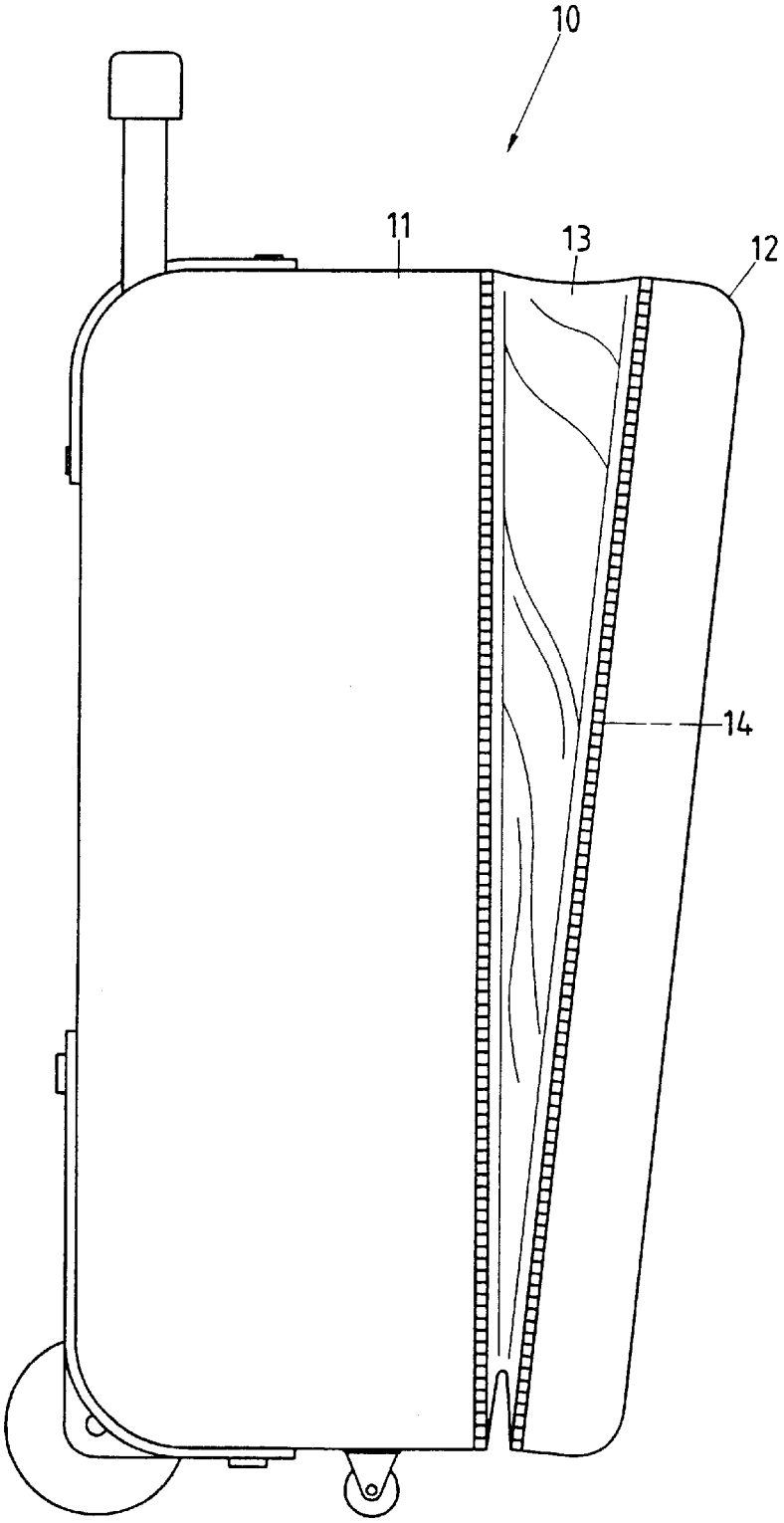
FIG.1 PRIOR ART
FIG. 1 shows a schematic view of a prior art luggage in use.
Figure 2:
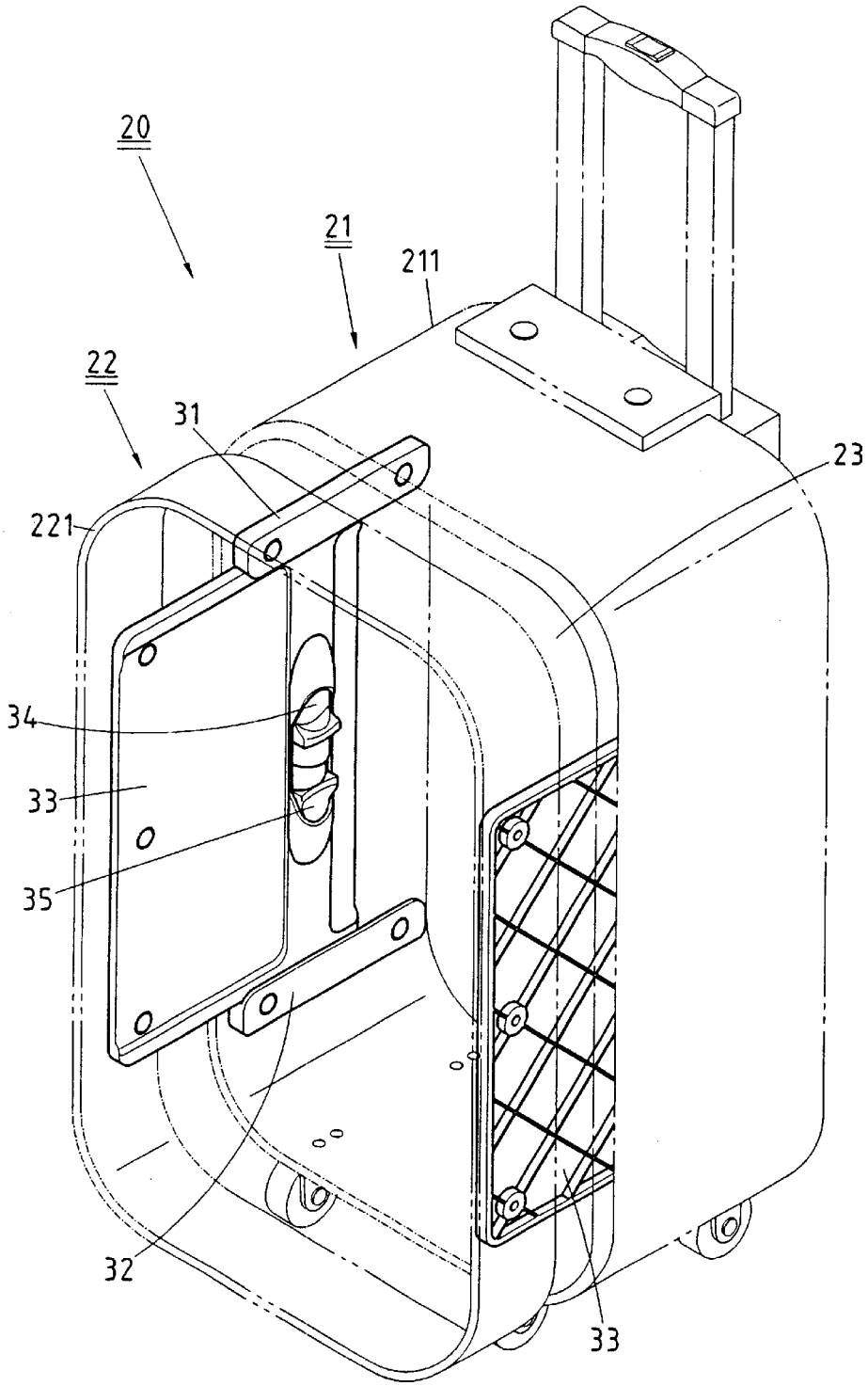
FIG. 2 shows a perspective view of the present invention.
Figure 3:
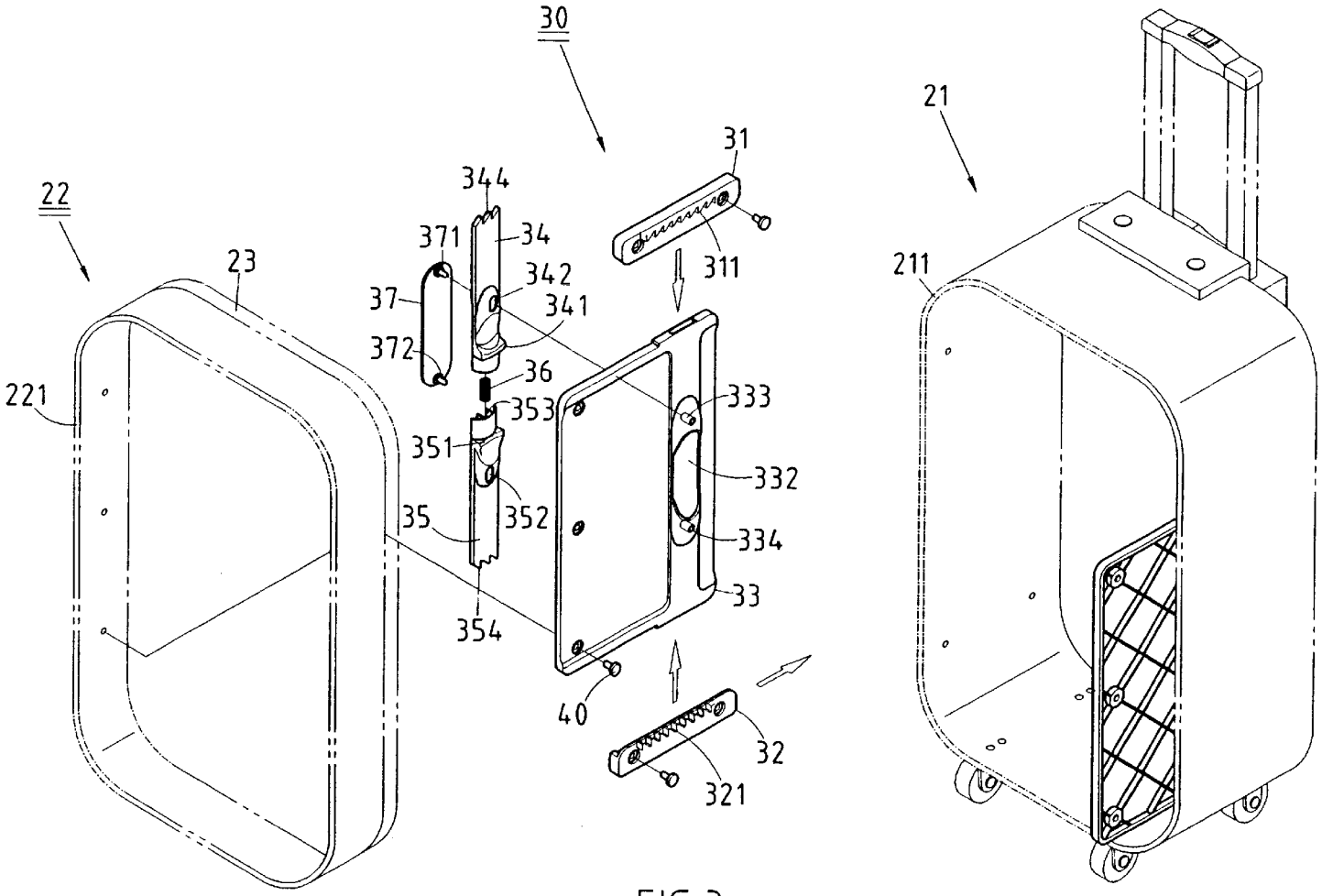
FIG. 3 shows an exploded view of the present invention.
Figure 4:
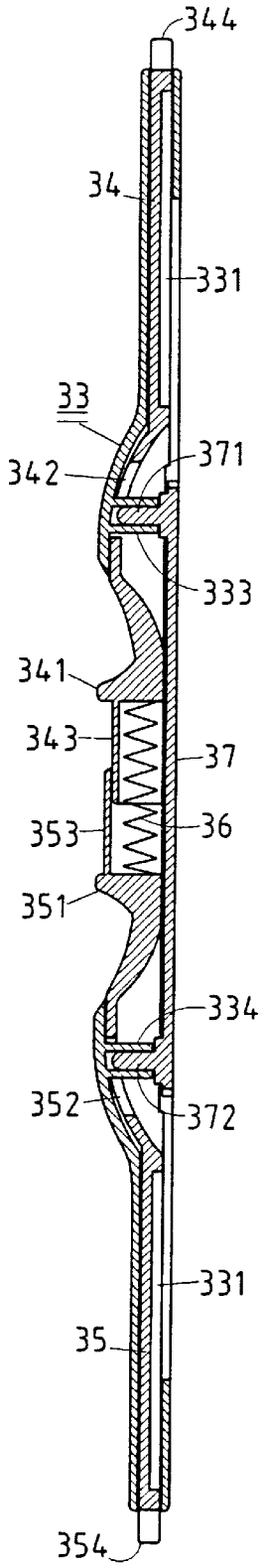
FIG. 4 shows a sectional view of the expansion structure of the present invention.
Figure 5:
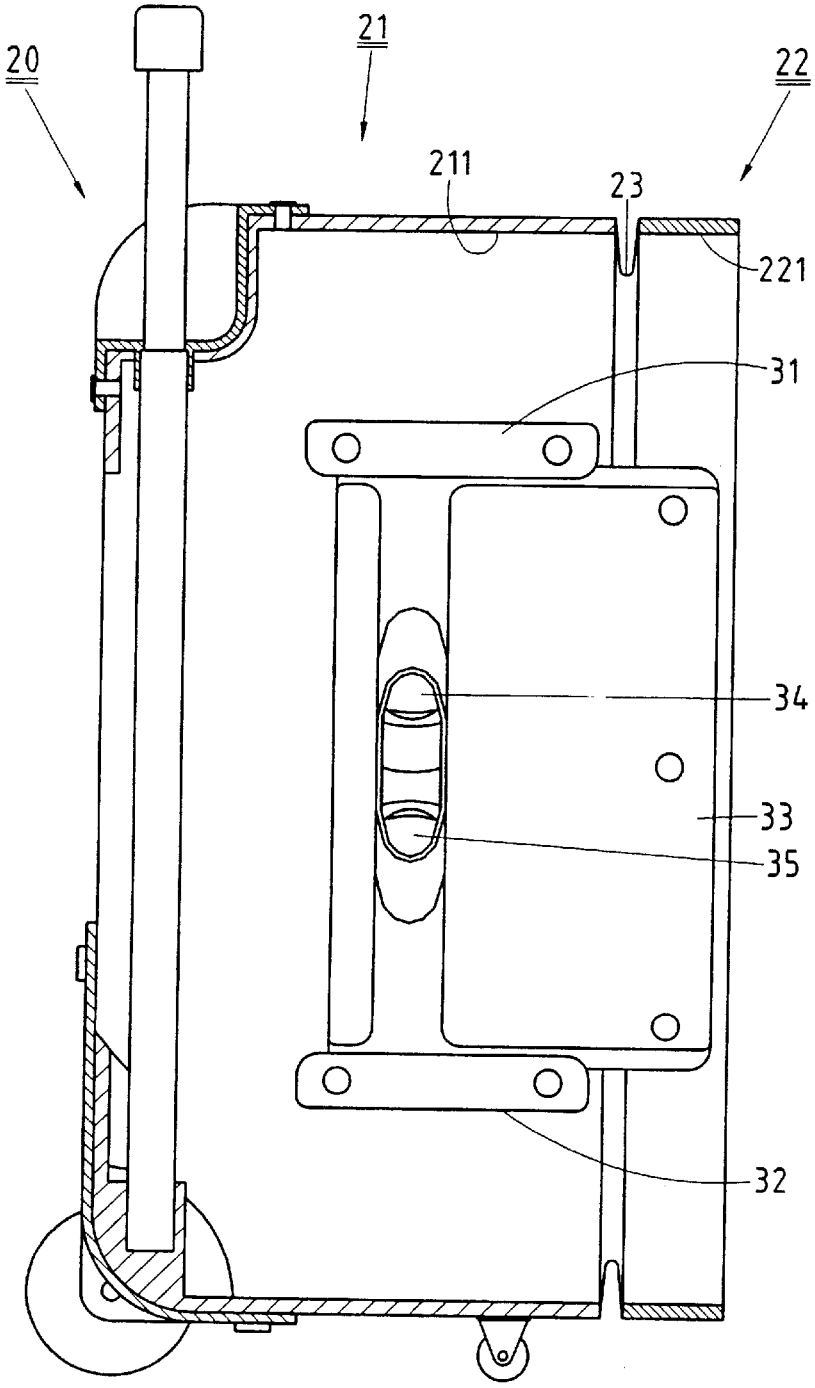
FIG. 5 shows a side sectional view of the present invention in the unexpanded state.
Figure 6:
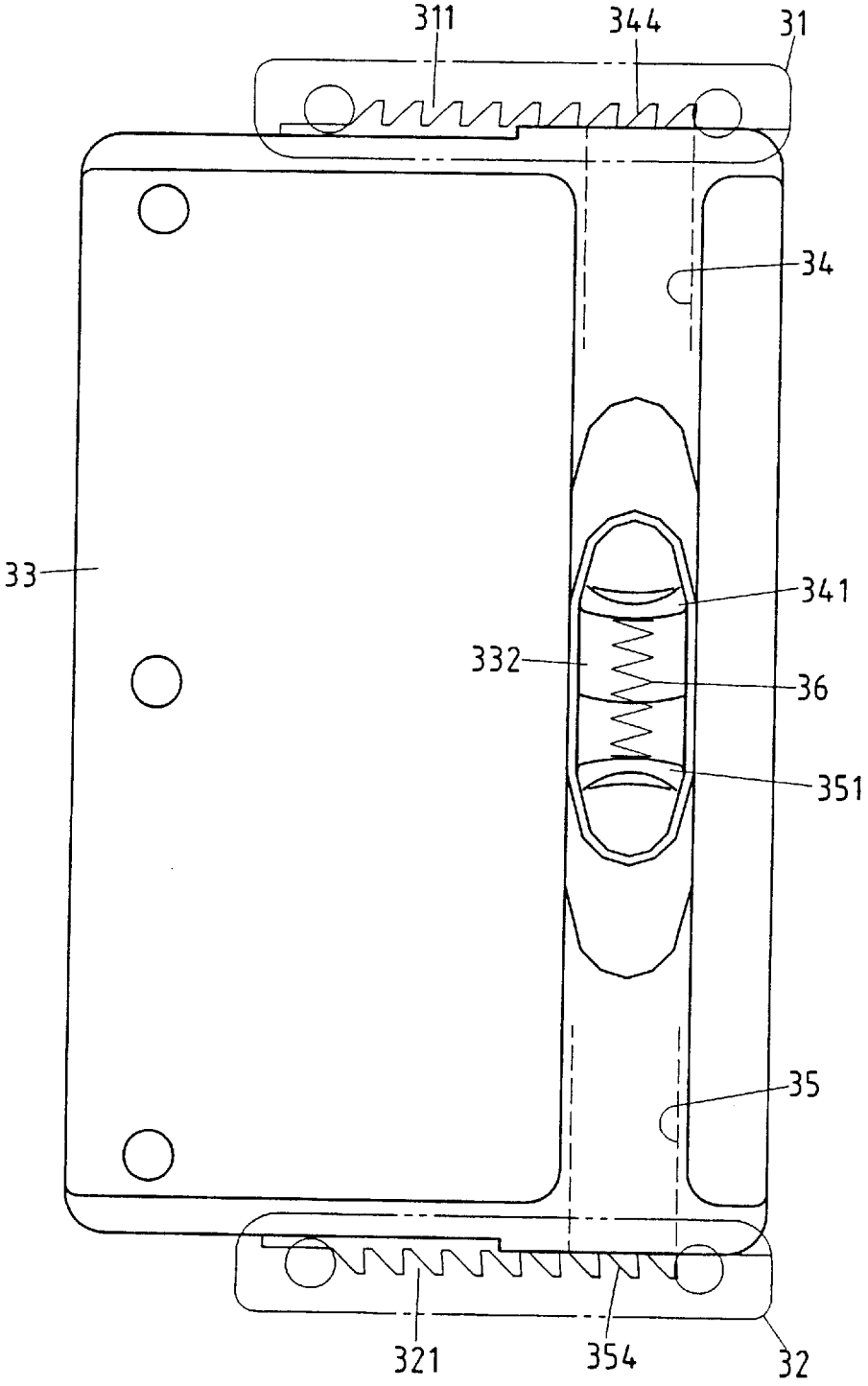
FIG. 6 shows a schematic plan view of the expansion structure of the present invention.
Figure 7:
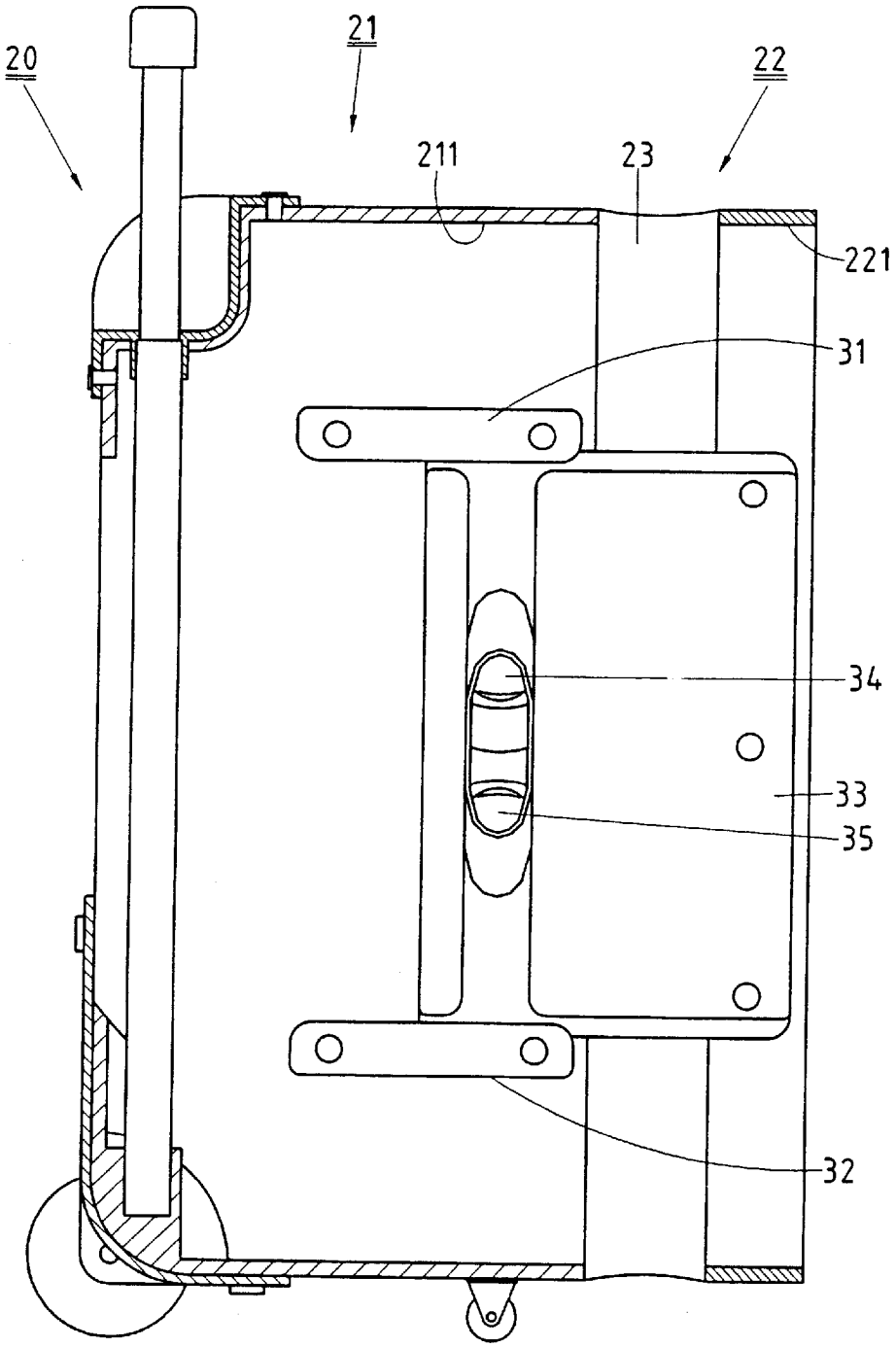
FIG. 7 shows a side sectional view of the present invention in the expanded state.
Figure 8:
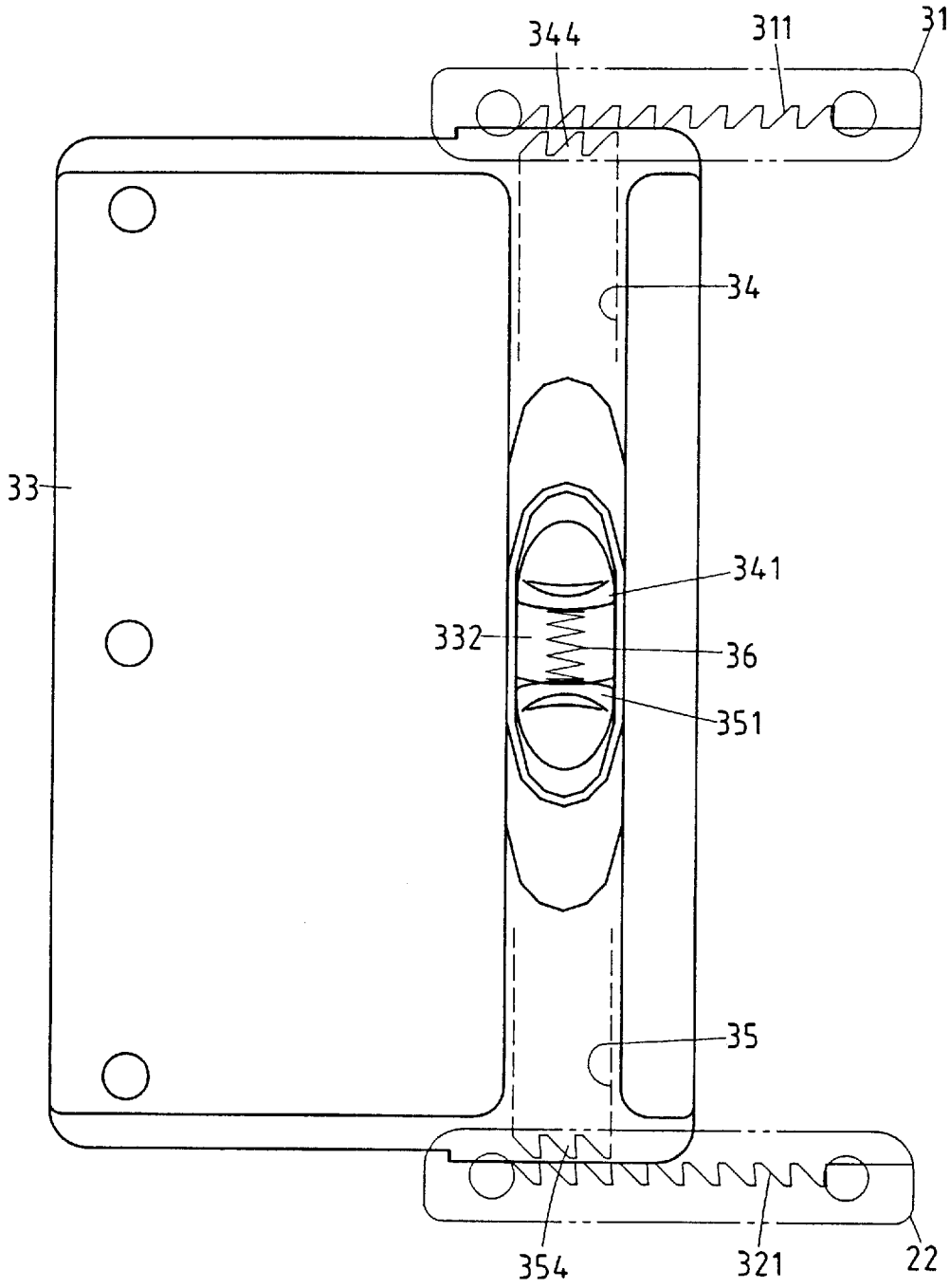
FIG. 8 shows another schematic plan view of the expansion structure of the present invention.

As shown in FIGS. 2–8, a luggage 20 embodied in the present invention is formed of a main body 21, a cover body 22, and an expansion portion provided in opposite inner sides thereof with an expansion structure 30 comprising two slide rails 31 and 32, an expansion board 33, an upper retaining rod 34, a lower retaining rod 35, a spring 36, and a locating board 37. The expansion board 33 is provided in the inner side with a longitudinal slot hole 331 which is in turn provided in the center with a side hole 332. The upper and the lower retaining rods 34 and 35 are respectively provided with a protruded piece 341, 351, and a long hole 342, 352. The upper and the lower retaining rods 34 and 35 are provided with a seat 343, 353 for retaining the spring 36. The retaining rods 34 and 35 are further provided at opposite ends with a toothed portion 344, 354. The toothed portions 344 and 354 are extended beyond the upper end and the lower end of the expansion board 33 such that the protruded pieces 341 and 351 of the retaining rods 34 and 35 are extended beyond the outer side of the expansion board 33. The locating board 37 is provided with two protruded pillars 371 and 372 opposite to each other. The protruded pillars 371 and 372 are retained in two tubular retainers 333 and 334 of the expansion board 33 via the long holes 342 and 352 of the two retaining rods 34 and 35. The upper and the lower retaining rods 34 and 35 are forced by the spring 36 to move up and down for an appropriate distance. The two slide rails 31 and 32 are fastened to the inner side of a frame 211 of the main body 21 and are provided with a rack 311, 321. The toothed portions 344 and 354 of the two retaining rods 34 and 35 are engaged with the racks 311 and 321 of the slide rails 31 and 32. The outer side edge of the expansion board 33 is fastened to the inner side edge of the frame 221 of the cover body 22 by a plurality of rivets 40. The expansion board 33 can be thus moved along the slide rails 31 and 32.

The toothed portions 344 and 354 of the retaining rods 34 and 35, as well as the racks 311 and 321 of the slide rails 31 and 32 have forward teeth with tooth direction facing the cover body 22 and reverse teeth with tooth direction facing the interior of the main body 21.

When the luggage 20 is not expanded in its holding capacity, the two expansion boards 33 are displaced toward the interior of the main body 21. The holding capacity of the luggage 20 is expanded by pulling the cover body 22 in the direction away from the main body 21, thereby causing the two expansion boards 33 to slide outward along the two slide rails 31 and 32. The holding capacity of the luggage 20 may be reduced by pressing the protruded pieces 341 and 351 of the upper and the lower retaining rods 34 and 35, so as to cause the toothed portions 344 and 354 of the two retaining rods 34 and 35 to disengage respectively the racks 311 and 321 of the two slide rails 31 and 32.

What is claimed is:

1. A luggage comprising a main body, a cover body, and an expansion portion connecting the main body and the cover body; wherein said main body has a frame which is provided in opposite inner sides with an expansion structure comprising two slide rails, an expansion board, an upper retaining rod, a lower retaining rod, a spring, and a locating board, said expansion board being provided in an inner side with a longitudinal slot hole which is in turn provided with a side hole, said upper retaining rod and said lower retaining rod being provided respectively with a protruded piece, a long hole, and a retaining seat for retaining said spring, said upper retaining rod and said lower retaining rod further provided respectively with a toothed portion extending beyond an upper end and a lower end of said expansion board such that said two protruded pieces extend beyond an outer side of said expansion board, said locating board being provided with two protruded pillars opposite to each other such that said two protruded pillars are retained in two tubular retainers of said expansion board via said long holes of said two retaining rods, said two retaining rods being forced by said spring to move up and down for an appropriate distance, said two slide rails being fastened to an inner side of said frame of said main body and provided with a rack, said racks of said two slide rails being engageable and disengageable with said two toothed portions of said two retaining rods, said expansion board having an outer side edge fastened with an inner side edge of a frame of said cover body by a plurality of rivets, said expansion board being moved along said two slide rails.

2. The luggage as defined in claim 1, wherein said toothed portions of said two retaining rods and said racks of said two slide rails have forward teeth with tooth direction facing said cover body, and reverse teeth with tooth direction facing the interior of said main body.

* * * * *